US007700170B2

(12) United States Patent
Motoda et al.

(10) Patent No.: US 7,700,170 B2
(45) Date of Patent: Apr. 20, 2010

(54) INK-JET RECORDING MATERIAL AND METHOD FOR PREPARING THE SAME

(75) Inventors: Makoto Motoda, Tokyo (JP); Hideto Kiyama, Tokyo (JP); Izumi Akaiwa, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 11/246,102

(22) Filed: Oct. 11, 2005

(65) Prior Publication Data

US 2006/0078694 A1 Apr. 13, 2006

(30) Foreign Application Priority Data

Oct. 12, 2004 (JP) ..... 2004-298132
Mar. 10, 2005 (JP) ..... 2005-067112

(51) Int. Cl.
*B41M 5/50* (2006.01)

(52) U.S. Cl. ..... 428/32.24; 428/32.18; 428/32.25; 428/32.26; 428/32.34; 428/32.35

(58) Field of Classification Search ..... 428/32.1, 428/32.25, 32.35, 32.18, 32.24, 32.26, 32.34
See application file for complete search history.

(56) References Cited

U.S. PATENT DOCUMENTS 6,150,289 A * 11/2000 Chen et al. ..... 501/148
6,576,326 B2 * 6/2003 Hatano et al. ..... 428/195.1
6,761,942 B2 7/2004 Katoh et al.
6,773,771 B1 8/2004 Ashida et al.
2001/0004487 A1 * 6/2001 Kaneko et al. ..... 428/195
2003/0072925 A1 * 4/2003 Kiyama et al. ..... 428/195
2003/0174195 A1 * 9/2003 Onishi et al. ..... 347/105
2003/0224129 A1 * 12/2003 Miyachi et al. ..... 428/32.1

FOREIGN PATENT DOCUMENTS

JP 2000-309157 A 11/2000
JP 2000-343810 * 12/2000
JP 2001-96897 A 4/2001
JP 2001-113819 A 4/2001
JP 2001-199153 A 7/2001
JP 2001-310548 A 11/2001
JP 2002-160442 A 6/2002
JP 2002-192830 A 7/2002
JP 2004-001240 A 1/2004
JP 2004-058575 A 2/2004

* cited by examiner

*Primary Examiner*—Betelhem Shewareged
(74) *Attorney, Agent, or Firm*—Birch, Stewart, Kolasch & Birch, LLP

(57) ABSTRACT

There are disclosed an ink-jet recording material having at least two ink-receptive layers mainly containing fine particulate silica on a support, which comprises an ink-receptive layer positioned farthest from the support contains a water-soluble zirconium compound, and the ink-jet recording material satisfies at least one of the following requirements (a) and (b):

(a) a water-soluble zirconium compound is present with a larger amount at a portion apart from the support than a portion nearer to the support, and a cationic emulsion is contained in the ink-receptive layer farthest from the support.

(b) a water-soluble aluminum compound is contained in an ink-receptive layer positioned nearer to the support, and a process for preparing the same.

5 Claims, No Drawings

INK-JET RECORDING MATERIAL AND METHOD FOR PREPARING THE SAME

BACKGROUND OF THE INVENTION

1. Field of the Invention

The present invention relates to an ink-jet recording material and a method for preparing the same, more specifically to an ink-jet recording material that is excellent in ink-absorption property, water resistance and coloring property when it is printed with an aqueous dye-based ink, is prevented from occurrence of bronzing and causes less bleeding under high-humidity conditions, and a method for preparing the same.

2. Background Art

As a recording material to be used for an ink-jet recording system, a recording material which comprises a porous ink-receptive layer comprising a pigment such as amorphous silica, and a water-soluble binder such as polyvinyl alcohol being provided on a support such as a usual paper or the so-called ink-jet recording sheet has generally been known.

For example, as disclosed in Japanese Unexamined Patent Publications No. Sho.55-51583, No. Sho.56-157, No. Sho.57-107879, No. Sho.57-107880, No. Sho.59-230787, No. Sho.62-160277, No. Sho.62-184879, No. Sho.62-183382 and No. Sho.64-11877, a recording material obtained by coating a silicon-containing pigment such as silica, etc., on a paper support with an aqueous binder has been proposed.

Also, in Japanese Patent Publication No. Hei.3-56552, Japanese Unexamined Patent Publications No. Hei.2-188287, No. Hei.10-81064, No. Hei.10-119423, No. Hei.10-175365, No. Hei.10-193776, No. Hei.10-203006, No. Hei.10-217601, No. Hei.11-20300, No. Hei.11-20306, No. Hei.11-34481 and No. 2000-211235, U.S. Pat. No. 5,612,281, and EP 0 813 978 A, and the like, there have been disclosed ink-jet recording materials using synthetic silica fine particles prepared by a gas phase process (hereinafter referred to as "fumed silica").

Also, in Japanese Unexamined Patent Publications No. Sho.62-174183, No. Hei.2-276670, No. Hei.5-32037, and No. Hei.6-199034, recording materials using alumina or alumina hydrate have been disclosed.

Alumina hydrate, alumina, and fumed silica are ultrafine particles each having an average particle diameter of the primary particles of several tens nm, and have characteristics that they give high glossiness and high ink-absorption property. Thus, in an ink-jet recording material required to have high image quality same as that of a silver halide photography, they are used in an ink-receptive layer, and as a support, a water-resistant support such as a paper support (resin-coated paper) on the surface of which are coated by a resin such as polyethylene, etc., or a polyester film, etc. has generally been used in the viewpoints of glossiness like a silver salt photography and feeling. However, such a water-resistant support itself does not absorb ink, so that a high-boiling point solvent remains in the ink-receptive layer as such, and when the printed material is preserved under high temperature and high-humidity for a long period of time after printing, the solvent is diffused with a dye in the ink-receptive layer whereby there is a problem that bleeding of an image (hereinafter referred to as "bleeding under high-humidity") is generated.

On the other hand, in the ink-jet recording material, it has been proposed to add a compound having an amino group or an ammonium salt, particularly to add a polymer compound having the same, for the purpose of fixing a dye component in the ink. For example, it has been known many compounds such as a (co)polymer of diallyl ammonium salt derivatives as disclosed in Japanese Unexamined Patent Publications No. Sho.60-83882, No. Sho.64-75281, Sho.59-20696, etc.; allylamine salt (co)polymers as disclosed in Japanese Unexamined Patent Publications No. 2002-274024, Sho.61-61887, No. Sho.61-72581, etc.; vinyl (co)polymers such as (meth) acrylate having an ammonium salt, (meth)acrylamide series (co)polymer having an ammonium salt, vinyl benzyl ammonium salt (co)polymer, etc., as disclosed in Japanese Unexamined Patent Publications No. Hei.8-108618, No. Hei.6-340163, No. Hei.4-288283, No. Hei.9-300810, No. Hei.8-318672, No. Hei.10-272830, Japanese Unexamined Patent Publication No. Sho.63-115780, etc.

Also, many compounds have been proposed to add them to an ink-jet recording material such as a modified polyvinyl alcohol (PVA) as disclosed in Japanese Unexamined Patent Publication No. Hei.10-44588, an amine-epichlorohydrine polyaddition compound as disclosed in Japanese Unexamined Patent Publication No. Hei.6-234268 and No. Hei.11-277888, etc., a dihalide-diamine polyaddition compound as disclosed in Japanese Unexamined Patent Publication No. Hei.10-119418, etc., a polyamidine as disclosed in Japanese Unexamined Patent Publications No. Hei.11-58934, No. Hei.11-28860, etc., a polymer of an allylamine hydrochloride, an allylamine, a diallyldimethyl ammonium salt, etc. as disclosed in Japanese Unexamined Patent Publication No. Hei.12-71603, etc. Also, in Japanese Unexamined Patent Publication No. Sho.63-280681, an ink-jet recording material using a polyamine substituted by a hydroxyalkyl having 2 to 3 carbon atoms has been disclosed.

However, according to the techniques using these polymer compounds having an amino group or an ammonium salt, bad effects are exerted in some cases on the ink-absorption property or coloring property of an ink-receptive layer using the above-mentioned fumed silica or alumina hydrate, which has a high void ratio, so that they cannot sufficiently satisfy these properties and high-humidity bleeding simultaneously.

To improve ink-absorption property and water-resistance, in Japanese Unexamined Patent Publication No. 2000-309157, paper for an ink-jet recording comprising an ink-receptive layer formed by silica and containing a water-soluble aluminum compound, a titanium compound and a zirconium compound has been disclosed, but it is insufficient in high-humidity bleeding, and yet it is also insufficient in occurrence of a phenomenon in which disorder in glossiness such as metal luster on the surface of a printed portion occurs, which is so-called bronzing. Bronzing is a phenomenon in which a coloring material of ink is not uniformly fixed onto the surface of an ink-receptive layer, and the coloring material is excessively agglomerated. Moreover, according to the technique disclosed therein, when a water-soluble cationic polymer is used in combination to improve high-humidity bleeding or water resistance, fine cracks tend to be generated so that coating property is desired to be improved.

Also, in Japanese Unexamined Patent Publications No. 2001-96897 and No. 2001-113819, an ink-jet recording material having an ink-receptive layer which comprises fumed silica containing a water-soluble metallic compound such as zirconium, etc. has been disclosed. Moreover, in Japanese Unexamined Patent Publications No. 2001-310548 and No. 2002-160442, an ink-jet recording material in which an ink-receptive layer is constituted by multi-layers comprising inorganic fine particles such as fumed silica has been disclosed. These materials are improved in ink-absorption property or high-humidity bleeding, but, in particular, they do not satisfy a sufficient level of high-humidity bleeding, and there are problems in coloring properties that tint is different due to change in humidity conditions at the time of storage, or bronzing is likely generated.

In Japanese Unexamined Patent Publication No. 2002-160422, there is disclosed paper for an ink-jet recording in which a water-soluble metallic compound is distributed with a larger amount at the portion of an ink-absorption layer apart from a support to prevent from bleeding under high-humidity circumstance, but an effect on high-humidity bleeding is still insufficient. Moreover, according to a combination of the above and a water-soluble cationic polymer as disclosed in Japanese Unexamined Patent Publication No. 2002-192830, it gives bad effects on an ink-absorption property or coloring property and it is not in a position of a satisfactory level, and thus, improvement thereof has been desired.

In Japanese Unexamined Patent Publication No. 2001-199153, a binder composition containing a polyvalent metal and a cationic polymer in an ink-receptive layer has been disclosed, but in this technique, a large amount of a cationic latex is required to be contained to realize a function of a binder, so that it causes bad effects on the ink-absorption property or causes a problem in coloring property since haze occurs at the ink-receptive layer whereby these problems are desired to be overcome.

In Japanese Unexamined Patent Publication No. 2004-58575, an ink-jet recording sheet in which a layer containing a cationic emulsion is provided under an ink-receptive layer is disclosed. This is a technique to improve water resistance or bleeding with a lapse of time, and adhesiveness between a support and an ink-receptive layer, but, in particular, it is insufficient with regard to bleeding generated under high-humidity circumstance or coloring property whereby these problems are desired to be overcome.

Moreover, it has also been known to use a zirconium compound or an aluminum compound in the ink-jet recording material. For example, in Japanese Unexamined Patent Publications No. 2000-309157, No. 2002-160442 and No. 2004-1240, ink-jet recording materials using a water-soluble aluminum compound and/or a water-soluble zirconium compound have been disclosed. However, these materials cannot satisfy all the ink-absorption property, water-resistance, coloring property, anti-bronzing, and anti-bleeding under high-humidity conditions with sufficiently satisfied degrees.

SUMMARY OF THE INVENTION

An object of the present invention is to provide an ink-jet recording material that is excellent in ink-absorption property, water resistance and coloring property when it is printed particularly with an aqueous dye-based ink, is prevented from occurrence of bronzing and causes less bleeding under high-humidity conditions, and a method for preparing the same.

Another object of the present invention is to provide an ink-jet recording material which is excellent in ink-absorption property and coloring property particularly when printing is carried out by using aqueous dye ink, less occurrence of bleeding under high-humidity circumstance, generates no fine cracks and is excellent in coating property without any surface defect.

The above-mentioned objects of the present invention can be basically accomplished by the following inventions.

(1) An ink-jet recording material having at least two ink-receptive layers mainly containing fine particulate silica on a support, which comprises an ink-receptive layer positioned farthest from the support contains a water-soluble zirconium compound, and the ink-jet recording material satisfies at least one of the following requirements (a) and (b):
   (a) a water-soluble zirconium compound is present with a larger amount at a portion apart from the support than a portion nearer to the support, and a cationic emulsion is contained in the ink-receptive layer farthest from the support.
   (b) a water-soluble aluminum compound is contained in an ink-receptive layer positioned nearer to the support.

(2) The ink-jet recording material of the above-mentioned (1), wherein the ink-receptive layer contains a hydrophilic binder, and a weight ratio (B/P) of the hydrophilic binder and the fine particulate silica in the ink-receptive layer positioned apart from the support is smaller than the weight ratio (B/P) of the same in the ink-receptive layer positioned nearer to the support.

(3) The ink-jet recording material of the above-mentioned (1), wherein a weight ratio of fine particulate silica contained in an ink-receptive layer (A) positioned nearer to the support and that in an ink-receptive layer (B) positioned farthest from the support is 10:1 to 10:8, the ink-receptive layer (B) contains a cationic emulsion, and a ratio of the water-soluble zirconium compound based on the fine particulate silica in the ink-receptive layer (A) is 1% by weight or less and a ratio of the same in the ink-receptive layer (B) is 3% by weight or more.

(4) The ink-jet recording material of the above-mentioned (1), wherein the ink-receptive layer (B) positioned farthest from the support is an uppermost layer.

(5) The ink-jet recording material of the above-mentioned (1), wherein a dry coated amount of the ink-receptive layer (A) positioned nearer to the support is 12 $g/m^2$ or more, and a dry coated amount of the ink-receptive layer (B) positioned farthest from the support and containing the water-soluble zirconium compound is 8 $g/m^2$ or less.

(6) A process for preparing the ink-jet recording material according to the above-mentioned (1), which comprises providing the ink-receptive layer (A) containing a water-soluble aluminum compound at a position nearer to a support by coating and providing the ink-receptive layer (B) containing a water-soluble zirconium compound at a position farthest from the support by coating when at least two ink-receptive layers mainly containing fine particulate silica are provided by coating on the support.

In the ink-jet recording material of the present invention, particularly when it is printed with an aqueous dye ink, a printed material excellent in ink-absorption property, water-resistance and coloring property, prevented from occurrence in bronzing and bleeding under high-humidity conditions (bleeding at high-humidity) can be obtained.

Also, in the ink-jet recording material of the present invention, an ink-receptive layer excellent in ink-absorption property and coloring property, bleeding-inhibiting effect under high-humidity circumstance without any surface defects such as fine cracks, etc., can be obtained particularly when printing is carried out by using an aqueous dye ink.

DESCRIPTION OF THE PREFERRED EMBODIMENTS

In the following, the present invention is explained in more detail.

The ink-receptive layer of the present invention mainly contains fine particulate silica. Here, the terms "mainly contains" mean the fine particulate silica is preferably contained in an amount of 60% by weight or more based on the total solid component constituting the ink-receptive layer, more preferably 65% by weight or more, further preferably 70% by weight or more. The upper limit thereof is 95% by weight or so. As the fine particulate silica, at least one of fumed silica which is synthetic silica, and a wet process silica is used. In the viewpoint of ink-absorption property and coloring property, fumed silica is more preferably used.

In a preferred first embodiment of the ink-jet recording material of the present invention, the ink-receptive layer of the present invention is characterized in that it is constituted by two or more layers, the ink-receptive layer positioned farthest from the support contains a water-soluble zirconium compound, and a distribution of the water-soluble aluminum compound is at random in the whole ink-receptive layers constituted by two or more layers and the water-soluble aluminum compound is present in a larger amount at the portion nearer to the support than the other portions.

As a process for preparing the above-mentioned ink-jet recording material of the first embodiment according to the present invention, when ink-receptive layers containing fine particulate silica are provided by coating on a support with two or more layers, a preparation method in which the ink-receptive layer containing the water-soluble aluminum compound is provided by coating at a side nearer to the support, and the ink-receptive layer containing the water-soluble zirconium compound is provided by coating at a side farthest from the support, is preferably used. In the following, the ink-receptive layer positioned nearer to the support is called to as "an ink-receptive layer (A)", and the ink-receptive layer positioned farthest from the support is called to as "an ink-receptive layer (B)".

In the first embodiment of the present invention, as mentioned above, the water-soluble zirconium compound is preferably coated by being contained in the ink-receptive layer (B), and after providing the ink-receptive layer (B) which may not contain any water-soluble zirconium compound by coating, an aqueous solution containing the water-soluble zirconium compound may be coated thereon.

In the first embodiment of the present invention, it is important that the water-soluble zirconium compound is contained in the ink-receptive layer (B), and the water-soluble zirconium compound may be or may not be contained in the ink-receptive layer (A). However, with regard to the water-soluble aluminum compound, it is essential that the distribution state thereof is at random in the whole ink-receptive layers provided on the support, and it exists with a larger amount at the portion nearer to the support than the other portions. Accordingly, it is preferred that the water-soluble aluminum compound is not contained in the ink-receptive layer (B), but a minute amount thereof may be added thereto within the range that the above-mentioned distribution state is satisfied. The terms "the distribution state thereof is at random" herein mentioned mean that the water-soluble aluminum compound exists with a larger amount at the portion nearer to the support among the whole ink-receptive layers, and a dry weight of the water-soluble aluminum compound contained in the ink-receptive layer (A) nearer to the support is larger than that contained in the ink-receptive layer (B).

Distribution of the water-soluble aluminum compound in the ink-receptive layers can be evaluated, for example, by measuring an amount of the aluminum element or zirconium element to the thickness direction of the ink-receptive layers with regard to a sectional surface sample of the ink-receptive layers prepared by microtome, etc. using EMPA (Electron Probe Micro Analyser) and the like.

In the first embodiment of the present invention, the water-soluble zirconium compound is preferably contained at least at a portion apart from the support, i.e., at a neighbor of the top surface of the whole ink-receptive layers with a larger amount. A content of the water-soluble zirconium compound in the ink-receptive layer (B) is preferably within the range of 0.5 to 15% by weight based on the amount of the fine particulate silica, more preferably in the range of 1 to 10% by weight, particularly preferably in the range of 4 to 10% by weight. Also, a content of the water-soluble aluminum compound in the ink-receptive layer (A) is preferably within the range of 0.5 to 15% by weight based on the amount of the fine particulate silica, more preferably in the range of 1 to 10% by weight. It is more preferred that the water-soluble zirconium is contained in the ink-receptive layer (A) in an amount of 0.05 to 0.5% by weight and the water-soluble zirconium compound is contained in the ink-receptive layer (B) in an amount of 0.6 to 10% by weight based on the amount of the fine particulate silica. Moreover, it is preferred that the water-soluble aluminum compound is contained in the ink-receptive layer (A) in an amount of 0.5 to 7% by weight and the water-soluble aluminum compound is contained in the ink-receptive layer (B) in an amount of 0.05 to 1% by weight based on the dried amount of the each ink-receptive layer.

Also, the ink-receptive layer (A) is preferably provided with a thick layer to ensure an absorption rate and an absorption capacity of the ink, and a dried coating amount of the ink-receptive layer (A) is preferably 12 $g/m^2$ or more, particularly preferably 15 $g/m^2$ or more. The upper limit thereof is about 30 $g/m^2$ or so.

For the purpose of the present invention, it is preferred to make a thickness of the ink-receptive layer (B) thin, and the water-soluble zirconium compound is contained at a neighbor of the surface of the ink-receptive layer (B) with a high density and good efficiency. A dried coating amount of the ink-receptive layer (B) is preferably 8 $g/m^2$ or less, particularly preferably in the range of 1 to 7 $g/m^2$.

In the first embodiment of the present invention, by being contained the water-soluble zirconium compound in the ink-receptive layer (B) apart from the support, i.e., being present the water-soluble zirconium compound at the neighbor of the surface of the ink-receptive layer (B), and by being distributed the water-soluble aluminum compound at the portion nearer to the support with a larger amount, in combination, the present inventors have found that coloring property, bleeding at high-humidity, water-resistance, and ink-absorption property are simultaneously improved without occurrence of bronzing.

A dye fixed by the water-soluble zirconium compound at the neighbor of the surface of the ink-receptive layer is excellent in bleeding resistance at high-humidity, and coloring property is also good. On the other hand, when the water-soluble aluminum compound is distributed with a larger amount at the neighbor of the surface, occurrence of bronzing and lowering in coloring property are caused. However, by distributing the water-soluble aluminum compound at the portion nearer to the support with a larger amount, water-resistance due to attachment of water, etc., is improved, and an ink-absorption property is improved which is a result of contribution of the above. To attain these effects with further higher level, as mentioned above, it is preferred that a thickness of the ink-receptive layer (B) apart from the support is made relatively thin, and a thickness of the ink-receptive layer (A) nearer to the support is made relatively thick.

Next, the water-soluble aluminum compound and the water-soluble zirconium compound to be used in the present invention are explained.

The water-soluble aluminum compound and the water-soluble zirconium compound may be either of a single salt and a complex salt of an inorganic acid(s) or an organic acid(s), or a metal complex.

The water-soluble aluminum compound to be used in the present invention may be mentioned, for example, an inorganic acid salt such as aluminum chloride or its hydrate, aluminum sulfate or its hydrate, aluminum alum, etc. Moreover, it has been known a basic poly(aluminum hydroxide) compound which is an inorganic series aluminum-containing cationic polymer.

Of these water-soluble aluminum compounds, those which can be added to a coating solution for forming the ink-receptive layer in a stable condition are preferred, and a basic poly(aluminum hydroxide) compound is preferably used. The compound is a water-soluble poly(aluminum hydroxide) a main component of which is represented by the following formula (1), (2) or (3), and which contains a polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

$$[Al_2(OH)_nCl_{6-n}]_m \quad (1)$$

$$[Al(OH)_3]_nAlCl_3 \quad (2)$$

$$Al_n(OH)_mCl_{(3n-m)} \; 0<m<3n \quad (3)$$

These materials are commercially available from Taki Chemical, K.K. (Japan) under the trade name of poly-(aluminum chloride) (PAC) as a water treatment agent, from Asada Chemical K.K. (Japan) under the trade name of poly-(aluminum hydroxide) (Paho), from K.K. Riken Green (Japan) under the trade name of Pyurakemu WT and other manufacturers with the same objects whereby various kinds of different grades can be easily obtained. In the present invention, these commercially available products may be used as such.

The water-soluble zirconium compound to be used in the present invention may include, for example, zirconium acetate, zirconium nitrate, basic zirconium carbonate, zirconium hydroxide, zirconium ammonium carbonate, zirconium potassium carbonate, zirconium sulfate, zirconium fluoride, zirconium chloride, zirconium chloride octahydrate, zirconium oxychloride, zirconium hydroxychloride, etc.

Of these water-soluble zirconium compounds, those which can be added to a coating solution for forming an ink-receptive layer in a stable condition are preferred, and zirconium acetate (zirconyl acetate) and/or zirconium oxychloride are particularly preferred.

These compounds are commercially available from DAIICHI KIGENSO KAGAKU KOGYO CO., LTD, under the trade names of Zircosol ZA-20, Zircosol ZC-2, etc., or available from Nippon Light Metal Co., Ltd. and the like.

In another preferred second embodiment of the ink-jet recording material according to the present invention, the ink-receptive layer is constituted by two or more layers, and a cationic emulsion is contained in an ink-receptive layer farthest from the support and a water-soluble zirconium compound is distributed with a larger amount at a portion apart from the support. An embodiment to realize the above constitution is explained more specifically below.

As a method for distributing the water-soluble zirconium compound at a portion apart from the support with a larger amount, there is a method in which a coating solution containing a water-soluble zirconium compound is coated on the surface of the ink-receptive layer provided by coating on the support, or a method in which a much amount of the water-soluble zirconium compound is contained in an ink-receptive layer (B) positioned apart from the support than in an ink-receptive layer (A) positioned nearer to the support. The latter method is explained below in detail.

The latter method can be specifically carried out by making a ratio of the water-soluble zirconium compound relative to fine particulate silica of the ink-receptive layer (B) higher than a ratio of the same of the ink-receptive layer (A). More specifically, the above-mentioned ratio of the ink-receptive layer (A) is preferably 1% by weight or less, and the ratio of the same of the ink-receptive layer (B) is preferably 3% by weight or more. The above-mentioned ratios of the ink-receptive layers (A) and (B) are ratios thereof in a coating solution which is to be coated for preparing an ink-receptive layer on the support, and do not mean a ratio thereof in a final ink-jet recording material produced by coating and drying. This is because, a part of the water-soluble zirconium compound is considered to be diffused beyond the layers during coating and drying procedures. The above-mentioned ratio of the ink-receptive layer (B) is more preferably in the range of 4 to 10% by weight.

When the latter embodiment is employed, the ink-receptive layer (A) is preferably made a main ink-absorption layer, and a weight ratio of fine particulate silica contained in the ink-receptive layers (A) and (B) is preferably 10:1 to 10:8, more preferably in the range of 10:2 to 10:5. Also, a total amount of the fine particulate silica contained in the ink-receptive layers (A) and (B) is preferably 10 to 45 g/m$^2$, particularly preferably 15 to 40 g/m$^2$. Moreover, the ink-receptive layer (B) is preferably an outermost layer.

In the second embodiment of the present invention, the ink-receptive layer (B) apart from the support contains a cationic emulsion. It is also possible to contain a cationic emulsion in the ink-receptive layer (A) nearer to the support.

Next, a cationic emulsion to be used in the second embodiment of the present invention is explained. The cationic emulsion means an aqueous emulsion which is cationic or is cationically modified, and there may be mentioned, for example, conjugated diene series copolymer emulsions such as a styrene-butadiene copolymer, a methyl methacrylate-butadiene copolymer, etc.; acryl series polymer emulsion such as a polymer or a copolymer of an acrylate(s) and a methacrylate(s), a polymer or a copolymer of acrylic acid and methacrylic acid, etc.; styrene-acryl series polymer emulsion such as styrene-acrylate copolymer, styrene-methacrylate copolymer, etc.; vinyl series polymer emulsion such as ethylene-vinyl acetate copolymer, etc.; those in which a urethane series emulsion having a urethane bond, etc., is cationized by using a cationic group, those in which a surface of an emulsion is cationized using a cationic surfactant, those in which polymerization is carried out in the presence of a cationic polyvinyl alcohol to distribute the polyvinyl alcohol on the surface of the emulsion, etc. Of these cationic emulsions, a cationic emulsion a main component of which comprises styrene-acryl series polymer particles is preferred.

A content of the cationic emulsion in the ink-receptive layer (B) is preferably in the range of 1 to 50% by weight based on an amount of the fine particulate silica, more preferably in the range of 5 to 20% by weight, particularly preferably in the range of 5 to 10% by weight.

In the second embodiment of the present invention, the present inventors have found out that ink-absorption property, coloring property, high-humidity bleeding and coating property are simultaneously improved by taking constitutions that a water-soluble zirconium compound is distributed with a larger amount at a portion apart from the support than that of the other portions, and a cationic emulsion is contained in the ink-receptive layer (B).

The water-soluble zirconium compound shows potent cross-linking reaction with a binder, and when the water-soluble zirconium compound is contained in an ink-receptive layer nearer to the support, a binding force between the ink-receptive layer and the support is lowered, and fine cracks are likely generated. Also, in order to improve water-resistance of high-humidity bleeding, when a conventionally known cationic compound such as a water-soluble aluminum compound and a polyallylamine derivative, etc. is contained with the water-soluble zirconium compound in an ink-receptive layer, fine cracks are similarly generated and surface defects are likely generated. However, in the second embodiment of the present invention, by distributing a water-soluble zirconium compound in an ink-receptive layer apart from the support with a larger amount than that of the other portion, good coloring property or high-humidity bleeding-preventing effect can be obtained without causing lowering in coating property due to occurrence of surface defects. Moreover, when a cationic emulsion and a water-soluble zirconium compound are contained in an ink-receptive layer apart from the support, a coloring agent of an aqueous dye ink is fixed with good efficiency at a neighbor of the surface of the ink-receptive layer without inhibiting ink-absorption property, so that the resulting material is markedly excellent in high-humidity bleeding-resistance and gives good coloring property. When either one of a cationic emulsion or a water-soluble zirconium compound is contained, high-humidity bleeding-resistance can be improved with a some extent, but these compounds are used in combination, excellent high-humidity bleeding-resistance which could never been obtained in a sole use can be obtained.

In the synthesized silica to be used in the present invention, they can be roughly classified into fumed silica and wet process silica according to the preparation processes.

Fumed silica is also called to as the drying method silica relative to the wet process method, and it can be generally prepared by a flame hydrolysis method. More specifically, it has generally been known a method in which silicon tetrachloride is burned with hydrogen and oxygen, and a silane such as methyl trichlorosilane or trichlorosilane may be used singly in place of silicon tetrachloride or as a mixture in combination with silicon tetrachloride. The fumed silica is commercially available from Nippon Aerosil K.K. (Japan) under the trade name of Aerosil, and K.K. Tokuyama (Japan) under the trade name of QS type, etc.

Fumed silica to be used in the present invention preferably has a primary particle size of 5 to 50 nm. To obtain higher glossiness, it is more preferred to use those having a primary particle size of 5 to 20 nm and a specific surface area measured by the BET (Brunauer-Emmett-Teller) method of 90 to 400 $m^2/g$. The BET method mentioned in the present invention means one of methods for measuring a surface area of powder material by a gas phase adsorption method and is a method of obtaining a total surface area possessed by 1 g of a sample, i.e., a specific surface area, from an adsorption isotherm. As an adsorption gas, a nitrogen gas has been frequently used, and a method of measuring an adsorption amount obtained by the change in pressure or a volume of a gas to be adsorbed has most frequently been used. Most well-known equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

The fumed silica exists as mentioned above in a state in which primary particles having several nm to several tens nm are agglomerated in a secondary state with a network structure or a chain-like state. It is preferred to disperse the fumed silica that an average particle size of the agglomerated particles (secondary particles) becomes 500 nm or less, more preferably, it is dispersed until the secondary particle size becomes 300 nm or less. Here, an average particle size of the agglomerated particles can be obtained by photographing using a transmission type electron microscope, and as a simple and easy method, it can be measured as a particle number median diameter using a laser scattering type particle size distribution measurement device (for example, manufactured by Horiba Ltd., LA910, trade name).

The wet process silica can be further classified into a precipitation method silica, a gel method silica and a sol method silica according to the preparation processes. The precipitation method silica can be prepared by reacting sodium silicate and sulfuric acid under alkali conditions, silica particles grown in particle size aggregated and precipitated, and then, they are processed through filtration, washing, drying, pulverization and classification to prepare a product. Secondary particles of the silica prepared by the method become soft agglomerated particles, and particles relatively easily pulverized can be obtained. As the precipitation method silica, it is commercially available from TOSOH SILICA CORPORATION (Japan) under the trade name of Nipsil, K.K. Tokuyama (Japan) under the trade name of Tokusil.

The gel method silica can be produced by reacting sodium silicate and sulfuric acid under acidic conditions. In this method, small silica particles are dissolved during ripening and so reprecipitated between other primary particles which are larger sized particles that primary particles are combined to each other. Thus, clear primary particles disappear and relatively hard agglomerated particles having an inner void structure are formed. It is commercially available, for example, from Mizusawa Industrial Chemicals, Ltd. under the trade name of Mizukasil, Grace Japan Co., Ltd. under the trade name of Cyrojet, and the like.

The sol method silica is also called to as colloidal silica and can be obtained by methathesis of sodium silicate by an acid, etc., or heating and ripening silica sol obtained by passing through an ion-exchange resin layer, and is commercially available from Nissan Chemical Industries, Ltd. (Japan) under the trade name of SNOWTEX.

As the wet process silica to be used in the present invention, it is precipitated silica or gel method silica. An average particle size (average secondary particle size) of these wet process silica is generally 1 μm or more. In the present invention, these wet process silica are pulverized until an average particle size thereof becomes 500 nm or less. They are preferably pulverized until an average particle size thereof becomes 300 nm or less. A lower limit of the particle size is about 50 nm or so. A particle size of the pulverized wet process silica can be obtained by a transmission type electron microscope or a laser scattering type particle size distribution measurement device as mentioned above.

The dispersing step of the wet process silica comprises a first dispersing step of adding silica fine particles to a dispersing medium and mixing (pre-dispersion) and a second dispersing step of dispersing a crude dispersion obtained by the first dispersing step by a dispersing device. The pre-dispersion in the first dispersing step can be carried out by using a usual propeller stirrer, a saw blade type dispersing machine, a turbine type stirrer, a homomixer type stirrer, an ultrasonic wave stirrer, etc. As a pulverizing method of the wet process silica, a wet type dispersing method in which silica dispersed in a dispersing medium is mechanically pulverized is preferably used. As the wet type dispersing device, a media mill such as a ball mill, a beads mill, a sand grinder, etc., a pressure type dispersing device such as a high-pressure homogenizer, an ultra high-pressure homogenizer, etc., a thin-film rotation type dispersing machine etc., an ultrasonic wave dispersing device, etc. can be used. In the present invention, a media mil such as a beads mill is particularly preferably used.

The wet process silica to be used in the present invention preferably has an average particle size (average secondary particle size) of 5 μm or more. By pulverizing silica having a relatively larger particle size, dispersion with a higher concentration can be realized. An upper limit of an average particle size of the wet process silica to be used in the present invention is not specifically limited, and an average particle size of the wet process silica is usually 200 μm or less.

As the wet process silica to be used in ink-receptive layer of the present invention, precipitated silica is preferably used. As mentioned above, secondary particles of the precipitated silica are soft agglomerated particles so that they are suitable for pulverization.

The fine particulate silica contained in the ink-receptive layer (A) is at least one selected from the group consisting of fumed silica and wet process silica, and the fumed silica and the wet process silica may be used in combination. When the silica are used in admixture, a weight ratio of the fumed silica and the wet process silica contained in the ink-receptive layer (A) is preferably within the range of 5:10 to 10:5. Also, the fine particulate silica contained in the ink-receptive layer (B) is preferably fumed silica which is excellent in transparency of the ink-receptive layer for heightening coloring property of an aqueous dye ink.

In the present invention, fine particulate silica is preferably cationized by adding a cationic polymer. It is preferred that the cationic polymer is contained in the above-mentioned dispersion or pulverization step.

As the cationic polymer to be used in the present invention, there may be mentioned a water-soluble cationic polymer having a quaternary ammonium group, a phosphonium group, or an acid adduct of a primary to tertiary amine. There may be mentioned, for example, polyethyleneimine, polydialkyldiallylamine, polyallylamine, alkylamine epichlorohydrine polycondensate, cationic polymers disclosed in Japanese Unexamined Patent Publication No. Sho.59-20696, No. Sho.59-33176, No. Sho.59-33177, No. Sho.59-155088, No. Sho.60-11389, No. Sho.60-49990, No. Sho.60-83882, No. Sho.60-109894, No. Sho.62-198493, No. Sho.63-494.78, No. Sho.63-115780, No. Sho.63-280681, No. Hei.1-40371, No. Hei.6-234268, No. Hei.7-125411, No. Hei.10-193776, WO 99/64248, etc. A weight average molecular weight of these cationic polymers to be used in the present invention is preferably 100,000 or less, more preferably 50,000 or less, particularly preferably in the range of 2,000 to 30,000.

In the present invention, an amount of the cationic polymer to be used is preferably in the range of 1 to 10% by weight based on the amount of the fine particulate silica.

The ink-receptive layer of the present invention preferably contains a hydrophilic binder for the purposes of maintaining characteristics as a film and obtaining high transparency and high permeating property of ink. As the hydrophilic binder, polyvinyl alcohol, polyethylene glycol, starch, dextrin, carboxymethyl cellulose or a derivative thereof are used, and particularly preferred hydrophilic binder is completely or partially saponified polyvinyl alcohol. Of the polyvinyl alcohols, particularly preferred are partially or completely saponified one having a saponification degree of 80% or more. A polyvinyl alcohol having an average polymerization degree of 500 to 5000 is preferably used.

A weight ratio (B/P) of the hydrophilic binder and the fine particulate silica in the ink-receptive layer is preferably in the range of 5 to 30% by weight, particularly preferably 5 to 25% by weight. In the present invention, to pass ink smoothly from the ink-receptive layer (B) apart from the support to the ink-receptive layer (A) nearer to the support, it is preferred to set the above-mentioned weight ratio (B/P) to that the value of the ink-receptive layer (B) is made smaller than that of the ink-receptive layer (A). In the present invention, it is preferred that B/P of the ink-receptive layer (A) is in the range of 10 to 25% by weight and B/P of the ink-receptive layer (B) is in the range of 5 to 20% by weight.

To the ink-receptive layer of the present invention, a cationic polymer which is the same as that to be used for cationizing the fine particulate silica as mentioned above may be added as an additive.

In the present invention, various kinds of oil droplets may be added to the ink-receptive layer to improve brittleness of the film or layer. Such oil droplets may be mentioned a hydrophobic high-boiling point organic solvent (for example, liquid paraffin, dioctyl phthalate, tricresyl phosphate, silicone oil, etc.) having a solubility in water at room temperature of 0.01% by weight or less, or polymer particles (for example, particles which are obtained by polymerizing at least one of polymerizable monomers such as styrene, butyl acrylate, divinyl benzene, butyl methacrylate, hydroxyethyl methacrylate, etc.) and they can be contained. Such oil droplets can be preferably used in the range of 10 to 50% by weight based on the amount of the hydrophilic binder.

In the present invention, in the ink-receptive layer, a film-hardening agent is preferably contained in combination with the hydrophilic binder. Specific examples of the film-hardening agent may include, for example, an aldehyde type compound such as formaldehyde and glutaraldehyde; a ketone compound such as diacetyl and chloropentanedione; a compound having a reactive halogen such as bis(2-chloro-ethylurea), 2-hydroxy-4,6-dichloro-1,3,5-triazine, and those as disclosed in U.S. Pat. No. 3,288,775; divinyl-sulfone; a compound having a reactive olefin as disclosed in U.S. Pat. No. 3,635,718; an N-methylol compound as disclosed in U.S. Pat. No. 2,732,316; an isocyanate compound as disclosed in U.S. Pat. No. 3,103,437; an aziridine compound as disclosed in U.S. Pat. No. 3,017,280 and No. 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid; a dioxane derivative such as dihydroxydioxane; an inorganic cross-linking agent such as chromium alum, zirconium sulfate, boric acid and a borate, and they may be used singly or in combination of two or more. Of these, boric acid and a borate are particularly preferred. An amount of the film-hardening agent to be added is preferably 0.1 to 40% by weight, more preferably 0.5 to 30% by weight based on the amount of the organic binder constituting the ink-receptive layer.

To the respective ink-receptive layers, various kinds of conventionally known additives such as a coloring dye, a coloring pigment, a UV absorber, an antioxidant, a dispersant of the pigment, an antifoaming agent, a leveling agent, an antiseptic agent, a fluorescent brightener, a viscosity stabilizer, a pH buffer, etc. may be added. Also, a pH of the coating solution for preparing the ink-receptive layer of the present invention is preferably in the range of 3.3 to 6.5, particularly preferably in the range of 3.5 to 5.5.

Also, in the ink-receptive layer, a thioether compound, carbohydrazide and its derivative can be contained whereby preservability after printing can be markedly improved.

The carbohydrazide derivative to be used in the present invention may be either a compound having one or more carbohydrazide structure in the same molecule or a polymer having the carbohydrazide structure at the molecule main chain or the side chain thereof.

As the thioether compound to be used in the present invention, there are an aromatic thioether compound in which aromatic groups are bonded to the both sides of the sulfur atom and an aliphatic thioether compound in which alkyl groups are bonded to the both sides of the sulfur atom and the like. Of these, an aliphatic thioether compound having a hydrophilic group is particularly preferred.

Incidentally, these compounds can be synthesized according to the conventionally known synthetic method or according to the synthetic methods as disclosed in Japanese Unexamined Patent Publication No. 2002-321447, No. 2003-48372, etc. Also, with regard to a part of the compounds, a commercially available product can be used as such.

In the present invention, a coating method of the ink-receptive layers may be a step-wise coating method in which the respective layers are coated one layer by one layer (for example, a blade coater, an air knife coater, a roll coater, a bar coater, a gravure coater, a reverse coater, etc.), or a multi-layer simultaneous coating method (for example, a slide bead coater or slide curtain coater, etc.), and the effects of the present invention can be obtained. In the present invention, a multi-layer simultaneous coating method can be preferably used.

As the support to be used in the present invention, there may be preferably used a water-resistant support including, for example, a plastic resin film including a polyester resin such as polyethylene terephthalate, etc., a diacetate resin, a triacetate resin, an acrylic resin, a polycarbonate resin, poly (vinyl chloride), a polyimide resin, cellophane, cellulose, etc., and those in which paper and a resin film are adhered to each other, a polyolefin resin-coated paper in which polyolefin resin layers are coated on the both surfaces of a base paper, etc. A thickness of these water-resistant supports is preferably 50 to 300 μm, more preferably 80 to 260 μm.

The polyolefin resin-coated paper support (hereinafter referred to as "polyolefin resin-coated paper") to be preferably used in the present invention is explained in detail below. A water content of the polyolefin resin-coated paper to be used in the present invention is not specifically limited, and in view of curing property, it is preferably in the range of 5.0 to 9.0%, more preferably in the range of 6.0 to 9.0%. The water content of the polyolefin resin-coated paper can be measured by an optional water content-measuring method. For example, an infrared water content measuring device, an oven-dry weight method, a dielectric constant method, Carl-Fischer method, etc.

A base paper constituting the polyolefin resin-coated paper is not particularly limited, and any paper generally used may be employed. More preferably, a smooth base paper such as that used as a paper for a photographic support may be preferably used. As pulp for constituting the base paper, natural pulp, regenerated pulp, synthetic pulp, etc. may be used singly or in combination of two or more. In the base paper, various additives conventionally used in the paper-making industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the sheet or paper.

A thickness of the base paper is not particularly limited, and preferably that having a good surface smoothness prepared by compressing paper during paper-making or after paper-making by applying pressure using a calender, etc. A basis weight thereof is preferably 30 to 250 g/m$^2$.

As a polyolefin resin for coating the base paper, it may include a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes (melt index) may be used singly or in combination of two or more. Also, to the resin of the polyolefin resin-coated paper, various kinds of additives including a white pigment such as titanium oxide, zinc oxide, talc, calcium carbonate, etc.; an aliphatic acid amide such as stearic acid amide, arachidic acid amide, etc.; an aliphatic acid metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added optionally combining two or more.

As a process for preparing the polyolefin resin-coated paper to be mainly used, there may be mentioned a so-called extrusion coating method in which a polyolefin resin is flown on a running base paper in a melting state under heating, whereby the resin is coated on the both surfaces of the base paper. Also, before coating the resin on the base paper, activation treatment such as a corona discharge treatment, a flame treatment, etc. is preferably applied to the front surface or to the both surfaces of the front and back surfaces. A thickness of the resin layer is not particularly limited, and is suitably in the range of about 5 to about 50 μm on the front surface or both of the front and back surfaces.

At the side of the water-resistant support on which the ink-receptive layers are provided by coating according to be used in the present invention, a subbing layer is preferably provided. The subbing layer is previously coated on the surface of the water-resistant support and dried before coating the ink-receptive layers. The subbing layer mainly contains a water-soluble polymer or polymer latex, etc., which can form a film. It is preferably a water-soluble polymer such as gelatin, polyvinyl alcohol, polyvinyl pyrrolidone, water-soluble cellulose, etc., particularly preferably gelatin. An attached amount of these water-soluble polymers is preferably 10 to 500 mg/m$^2$, more preferably 20 to 300 mg/m$^2$. Moreover, to the subbing layer, other surfactant(s) or film hardening agent(s) is/are preferably added. By providing the subbing layer on the support, it effectively acts on preventing from causing crack at the time of coating the ink-receptive layer whereby a uniform coating surface can be obtained.

At the side having an ink-absorption property of the ink-jet recording material of the present invention and at the opposite surface to the support, various kinds of backing layer may be provided to prevent from causing curl or sticking at the time of overlapping the printed sheets immediately after printing or to more improve ink transfer.

In the following, the present invention is explained in more detail by referring to Examples, but the contents of the present invention are not limited by these Examples.

EXAMPLE 1

<Preparation of Polyolefin Resin-coated Paper>

A mixture of a bleached kraft pulp of hardwood (LBKP) and a bleached sulfite pulp of hardwood (NBSP) with a weight ratio of 1:1 was subjected to beating until it becomes 300 ml by the Canadian Standard Freeness to prepare a pulp slurry. To the slurry were added alkyl ketene dimer in an amount of 0.5% by weight based on the amount of the pulp as a sizing agent, polyacrylamide in an amount of 1.0% by weight based on the same as a strengthening additive of paper, cationic starch in an amount of 2.0% by weight based on the same, and polyamide epichlorohydrin resin in an amount of 0.5% by weight based on the same, and the mixture was diluted by water to prepare a 1% by weight slurry. This slurry was made paper by a fourdrinier paper machine to have a basis weight of 170 g/m$^2$, dried and subjected to moisture conditioning to prepare a base paper for a polyolefin resin-coated paper. A polyethylene resin composition comprising 100% by weight of a low density polyethylene having a density of 0.918 g/cm$^3$ and 10% by weight of anatase type titanium dioxide dispersed uniformly in the resin was melted at 320° C. and the melted resin composition was subjected to extrusion coating on the above-mentioned base paper with a thickness of 35 μm by 200 m/min and subjected to extrusion coating by using a cooling roller subjected to slightly roughening treatment to provide a front resin layer. On the other surface of the base paper, a blended resin composition comprising 70 parts by weight of a high density polyethylene resin having a density of 0.962 g/cm$^3$ and 30 parts by weight of a low density polyethylene resin having a density of 0.918 g/cm$^3$ was melted similarly at 320° C. and the melted resin composition was subjected to extrusion coating with a thickness of 30 μm and subjected to extrusion coating by using a cooling roller subjected to roughening treatment to provide a back resin layer.

Onto the surface of the above-mentioned polyolefin resin-coated paper was applied a high-frequency corona discharge treatment, and then, a subbing layer with the following composition was coated and dried so as to the gelatin amount of 50 mg/m$^2$ to prepare a support. Incidentally, all "part(s)" in the following means "part(s) by weight".

| <Subbing layer> | |
|---|---|
| Lime-treated gelatin | 100 parts |
| 2-Ethylhexyl sulfosuccinate | 2 parts |
| Chromium alum | 10 parts |

Onto the surface on which the subbing layer has been provided on the support prepared as mentioned above, a coating solution for an ink-receptive layer (A-1) having the composition as mentioned below as a lower layer (a layer nearer to the support), and a coating solution for an ink-receptive layer (B-1) having the composition as mentioned below as an upper layer (a layer apart from the support) were subjected to simultaneous multi-layer coating by a slide bead coater. A dried coated amount of the ink-receptive layer (A-1) was 20 g/m$^2$, and that of the ink-receptive layer (B-1) was 5 g/m$^2$. Drying conditions after the coating were that it was cooled at 10° C. for 20 seconds, and dried by blowing a hot air of 30 to 55° C.

| <Preparation of Fumed silica dispersion 1> | |
|---|---|
| Water | 430 parts |
| Modified ethanol | 22 parts |
| Cationic polymer (Dimethylallyl ammonium chloride homopolymer, available from Daiichi Kogyo Seiyaku K.K., Japan, Sharol DC902P, trade name, Average molecular weight: 9000) | 3 parts |
| Fumed silica (average primary particle size: 7 nm, specific surface area by the BET method: 300 m$^2$/g) | 100 parts |

To a dispersing medium comprising water and modified ethanol was added a dimethylallyl ammonium chloride homopolymer, and then, fumed silica was added and the mixture was provisionally dispersed to obtain a crude dispersion. Next, this crude dispersion was treated twice by a high pressure homogenizer to prepare a dispersion of fumed silica with a silica concentration of 20% by weight. An average particle size of the fumed silica was 100 nm.

| <Coating solution for Ink-receptive layer A-1> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| Basic poly(aluminum hydroxide) (available from K.K. Riken Green, Pyurakemu WT, trade name) | 3 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

| <Coating solution for Ink-receptive layer B-1> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Zirconyl acetate (available from DAIICHI KIGENSO KAGAKU KOGYO CO., LTD., Zircosol ZA-20, trade name) | 3 parts |
| Surfactant (Betaine series; available from Nippon Surfactant Kogyo K.K., Japan, SWANOL AM-2150, trade name) | 0.3 part |

EXAMPLE 2

An ink-jet recording material of Example 2 was obtained in the same manner as in Example 1 except for changing the coating solution for the ink-receptive layer B-1 of Example 1 to a coating solution for an ink-receptive layer B-2 mentioned below.

| <Coating solution for Ink-receptive layer B-2> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Zirconyl acetate (available from DAIICHI KIGENSO KAGAKU KOGYO CO., LTD., Zircosol ZA-20, trade name) | 6 parts |
| Surfactant (Betaine series; available from Nippon Surfactant Kogyo K.K., Japan, SWANOL AM-2150, trade name) | 0.3 part |

EXAMPLE 3

An ink-jet recording material of Example 3 was obtained in the same manner as in Example 1 except for changing the coating solution for the ink-receptive layer B-1 of Example 1 to a coating solution for an ink-receptive layer B-3 mentioned below.

| <Coating solution for Ink-receptive layer B-3> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Zirconium oxychloride (available from Nippon Light Metal Co., Ltd.) | 3 parts |
| Surfactant (Betaine series; available from Nippon Surfactant Kogyo K.K., Japan, SWANOL AM-2150, trade name) | 0.3 part |

EXAMPLE 4

| <Preparation of wet process silica dispersion 1> | |
|---|---|
| Water | 329 parts |
| Cationic polymer (Dimethylallyl ammonium chloride homopolymer, available from Daiichi Kogyo Seiyaku K.K., Japan, Sharol DC902P, trade name, Average molecular weight: 9000) | 4 parts |
| Precipitated silica (Nipsil VN3, trade name, average secondary particle size: 23 μm) | 100 parts |

Precipitated silica was added to water, and a provisional dispersion was prepared by using a saw blade type dispersing device (blade peripheral speed: 30 m/sec). Next, the provisional dispersion was passed through a beads mill (zirconia beads with a diameter of 0.3 mm, a filling ratio of the beads: 80% by volume, disc peripheral speed: 10 m/sec) to prepare a wet process silica dispersion 1 with a solid concentration of 30% by weight and an average particle size 200 nm.

An ink-jet recording material of Example 4 was obtained in the same manner as in Example 1 except for changing the coating solution for the ink-receptive layer A-1 of Example 1 to a coating solution for an ink-receptive layer A-2 mentioned below.

| <Coating solution for Ink-receptive layer A-2> | |
|---|---|
| Fumed silica dispersion 1 (as a solid content of the fumed silica) | 50 parts |
| Wet process silica dispersion 1 (as a solid content of the wet process silica) | 50 parts |
| Boric acid | 3 parts |
| Polyvinyl alcohol (Saponification degree: 88%, Average polymerization degree: 3500) | 22 parts |
| Zirconyl acetate (available from DAIICHI KIGENSO KAGAKU KOGYO CO., LTD., Zircosol ZA-20, trade name) | 3 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

COMPARATIVE EXAMPLE 1

An ink-jet recording material of Comparative example 1 was obtained in the same manner as in Example 1 except for changing the coating solution for the ink-receptive layer B-1 of Example 1 to a coating solution for an ink-receptive layer B-4 mentioned below.

| <Coating solution for Ink-receptive layer B-4> | |
|---|---|
| Fumed silica dispersion 2 (as a solid content of the fumed silica) | 100 parts |
| Boric acid | 3 parts |
| Polyvinyl alcohol (Saponification degree: 88%, Average polymerization degree: 3500) | 20 parts |
| Surfactant (Betaine series; available from Nippon Surfactant Kogyo K.K., Japan, SWANOL AM-2150, trade name) | 0.3 part |

COMPARATIVE EXAMPLE 2

An ink-jet recording material of Comparative example 2 was obtained in the same manner as in Example 1 except for changing the coating solution for the ink-receptive layer A-1 of Example 1 to a coating solution for an ink-receptive layer A-3 mentioned below and changing the coating solution for the ink-receptive layer B-1 of Example 1 to a coating solution for an ink-receptive layer B-5 mentioned below.

| <Coating solution for Ink-receptive layer A-3> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| Zirconyl acetate (available from DAIICHI KIGENSO KAGAKU KOGYO CO., LTD., Zircosol ZA-20, trade name) | 3 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

| <Coating solution for Ink-receptive layer B-5> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Basic poly(aluminum hydroxide) (available from K.K. Riken Green, Pyurakemu WT, trade name) | 3 parts |
| Surfactant (Betaine series; available from Nippon Surfactant Kogyo K.K., Japan, SWANOL AM-2150, trade name) | 0.3 part |

COMPARATIVE EXAMPLE 3

An ink-jet recording material of Comparative example 3 was obtained in the same manner as in Example 1 except for changing the coating solution for the ink-receptive layer A-1 of Example 1 to a coating solution for an ink-receptive layer A-4 mentioned below.

| <Coating solution for Ink-receptive layer A-4> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

COMPARATIVE EXAMPLE 4

An ink-jet recording material of Comparative example 4 was obtained in the same manner as in Example 1 except for changing the coating solution for the ink-receptive layer A-1 of Example 1 to a coating solution for an ink-receptive layer A-5 mentioned below and coating it on the support with a single layer and with a dried coating amount of 25 g/m$^2$ with a slide bead coating device, and dried in the same manner as in Example 1.

| <Coating solution for Ink-receptive layer A-5> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| Zirconyl acetate (available from DAIICHI KIGENSO KAGAKU KOGYO CO., LTD., Zircosol ZA-20, trade name) | 3 parts |
| Basic poly(aluminum hydroxide) (available from K.K. Riken Green, Pyurakemu WT, trade name) | 3 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.3 part |

With regard to the ink-jet recording sheets prepared as mentioned above, the following evaluations were carried out. The results are shown in Table 1.

<Ink-absorption Property>

By using a commercially available ink-jet printer (manufactured by Cannon Inc., BJF895PD), solid printings with red and green which were multiple-color system were carried out adjacent to each other alternately, and an absorption state of ink at the solid printing portion, mottling (dense and pale unevenness of image) and a degree of bleeding at the boarder of red and green immediately after the printing were observed with naked eyes. They are evaluated according to the following criteria.

◎: Ink was rapidly absorbed, and neither mottling nor bleeding at the boarder was admitted.

○: Absorption of ink is slightly slow, bleeding at the boarder was slightly admitted, but there is practically no problem.

Δ: Ink was slightly overflow at the printing surface, and mottling and bleeding at the boarder were slightly admitted.

X: Ink was overflow at the printing surface, and strong mottling and bleeding at the boarder occurred.

<Coloring Property>

By using a commercially available ink-jet printer (manufactured by Hewlett-Packard Development Company, L.P., deskjet 5550), a degree of subdue of composite black comprising mixed colors of C, M and Y was measured by observing color density of the respective colors of C, M and Y with naked eyes. They are evaluated according to the following criteria.

◎: No subdue is observed, and coloring property is good.

○: Subdue is slightly observed, but coloring property is good.

Δ: Subdue is slightly observed, and inferior-in coloring property.

X: Occurrence of strong subdue is admitted, and inferior in coloring property.

<Bronzing>

By using a commercially available ink-jet printer (manufactured by Cannon Inc., PIXUS 990i), solid portions of cyan, blue and black were printed and occurrence or absence of bronzing was evaluated with naked eyes. They are evaluated according to the following criteria.

◎: No occurrence of bronzing.

○: Bronzing was slightly admitted to a part of color.

Δ: Bronzing was admitted to a part of color.

X: Bronzing occurred on the whole colors.

<Bleeding at High-Humidity>

By using a commercially available ink-jet printer (manufactured by Cannon Inc., PIXUS 850i), each of fine lines of red, green, blue and composite black was printed and preserved under the conditions at 30° C. and 80% relative humidity for one week. Thereafter, these samples were observed with naked eyes. They are evaluated according to the following criteria.

◎: No bleeding

○: Bleeding was slightly admitted

Δ: Bleeding was admitted

X: Remarkably bleed

<Water-resistance>

By using a commercially available ink-jet printer (manufactured by Cannon Inc., PIXUS 850i), a sample in which red color characters were printed on a black solid printed portion was dipped in flowing water at 20° C. and bleeding of the image was observed with naked eyes. They are evaluated according to the following criteria.

◎: No bleeding

○: Bleeding was slightly admitted

Δ: Bleeding was admitted

X: Remarkably bleed

TABLE 1

| Sample | Ink-absorption property | Coloring property | Bronzing | Bleeding | Water-resistance |
|---|---|---|---|---|---|
| Example 1 | ◎ | ○ | ◎ | ○ | ◎ |
| Example 2 | ◎ | ◎ | ◎ | ◎ | ◎ |
| Example 3 | ◎ | ○ | ◎ | ○ | ◎ |
| Example 4 | ○ | ○ | ◎ | ○ | ○ |
| Comparative example 1 | ○ | Δ | ○ | X | ◎ |
| Comparative example 2 | Δ | Δ | X | Δ | ◎ |
| Comparative example 3 | Δ | ○ | ○ | ○ | X |
| Comparative example 4 | ○ | Δ | X | ○ | ○ |

Ink-jet recording material of Examples 1 to 4 according to the present invention showed the results that they were excellent in ink-absorption property, water-resistance, coloring property, preventing bronzing, and bleeding at high-humidity of the ink-receptive layers. With regard to Comparative example 1, no water-soluble zirconium compound is contained in the ink-receptive layer B apart from the support so that it gave a result that bleeding at high-humidity and coloring property was poor. With regard to Comparative example 2, distributions of the water-soluble zirconium compound and the water-soluble aluminum compound are reverse to those of the present invention so that it gave a result that bronzing occurred, and ink-absorption property, coloring property and bleeding at high-humidity were poor. With regard to Comparative example 3, no water-soluble aluminum compound is contained in the ink-receptive layer A so that it gave a result that water-resistance and ink-absorption property were poor. With regard to Comparative example 4, it is the case where the layer constitution is single and the water-soluble aluminum compound and the water-soluble zirconium compound were co-present therein, and it gave a result that coloring property and bronzing were poor.

EXAMPLE 5

On a surface on which a subbing layer had been provided of a support prepared in Example 1, a coating solution for an ink-receptive layer (A-6) containing fumed silica dispersion 1 of Example 1 as an under layer (a layer nearer to the support), and a coating solution for an ink-receptive layer (B-6) as an upper layer (a layer apart from the support) were simultaneously multi-layer coated by a slide bead coater. A coated amount of the fine particulate silica of the ink-receptive layer (A-6) was 12 g/m$^2$, and a coated amount of the fine particulate silica of the ink-receptive layer (B-6) was 8 g/m$^2$. Drying conditions after coating were that the material was cooled at 10° C. for 20 seconds, and then, dried by blowing warmed air at 30 to 55° C.

| <Coating solution for Ink-receptive layer (A-6)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| Cationic water-soluble polymer (available from Nitto Boseki Co., Ltd., polyallylamine PAA-HCl-3L, trade name) | 1 part |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

| <Coating solution for Ink-receptive layer (B-6)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Cationic emulsion (Styrene-acryl series; available from Seiko PMC Corporation, SE2220, trade name) | 4 parts |
| Zirconyl acetate (available from DAIICHI KIGENSO KAGAKU KOGYO CO., LTD., Zircosol ZA-20, trade name) | 4 parts |
| Surfactant (Betaine series; available from Nippon Surfactant Kogyo K.K., Japan, SWANOL AM-2150, trade name) | 0.3 part |

EXAMPLE 6

An ink-jet recording material of Example 6 was obtained in the same manner as in Example 5 except for changing the coating solution for the ink-receptive layer (B-6) of Example 5 to a coating solution for an ink-receptive layer (B-7) mentioned below.

| <Coating solution for Ink-receptive layer (B-7)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Cationic emulsion (Styrene-acryl series; available from Harima Chemicals, Inc., CP-5, trade name) | 4 parts |
| Zirconyl acetate (available from DAIICHI KIGENSO KAGAKU KOGYO CO., LTD., Zircosol ZA-20, trade name) | 4 parts |
| Surfactant (Betaine series; available from Nippon Surfactant Kogyo K.K., Japan, SWANOL AM-2150, trade name) | 0.3 part |

EXAMPLE 7

An ink-jet recording material of Example 7 was obtained in the same manner as in Example 5 except for changing the coating solution for the ink-receptive layer (B-6) of Example 5 to a coating solution for an ink-receptive layer (B-8) mentioned below.

| <Coating solution for Ink-receptive layer (B-8)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Cationic emulsion (Styrene-acryl series; available from Seiko PMC Corporation, SE2220, trade name) | 4 parts |
| Zirconium oxychloride (available from Nippon Light Metal Co., Ltd.) | 4 parts |
| Surfactant (Betaine series; available from Nippon Surfactant Kogyo K.K., Japan, SWANOL AM-2150, trade name) | 0.1 part |

EXAMPLE 8

An ink-jet recording material of Example 8 was obtained in the same manner as in Example 5 except for changing the coating solution for the ink-receptive layer (A-6) of Example 5 to a coating solution for an ink-receptive layer (A-7) mentioned below.

| <Coating solution for Ink-receptive layer (A-7)> | |
|---|---|
| Wet process silica dispersion 1 (as a solid content of the wet process silica) | 50 parts |
| Fumed silica dispersion 1 (as a solid content of the fumed silica) | 50 parts |
| Boric acid | 3 parts |
| Polyvinyl alcohol (Saponification degree: 88%, Average polymerization degree: 3500) | 22 parts |
| Cationic water-soluble polymer (available from Nitto Boseki Co., Ltd., polyallylamine PAA-HCl-3L, trade name) | 1 part |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

EXAMPLE 9

An ink-jet recording material of Example 9 were obtained in the same manner as in Example 8 except for changing the coating solution for the ink-receptive layer (B-6) of Example 8 to a coating solution for an ink-receptive layer (B-9) mentioned below.

| <Coating solution for Ink-receptive layer (B-9)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Cationic emulsion (Styrene-acryl series; available from NICCA CHEMICAL CO., LTD., Nicca Salt SUP, trade name) | 4 parts |
| Zirconyl acetate (available from DAIICHI KIGENSO KAGAKU KOGYO CO., LTD., Zircosol ZA-20, trade name) | 4 parts |

-continued

| <Coating solution for Ink-receptive layer (B-9)> | |
|---|---|
| Surfactant (Betaine series; available from Nippon Surfactant Kogyo K.K., Japan, SWANOL AM-2150, trade name) | 0.3 part |

COMPARATIVE EXAMPLE 5

An ink-jet recording material of Comparative example 5 was obtained in the same manner as in Example 5 except for changing the coating solution for the ink-receptive layer (A-5) of Example 5 to a coating solution for an ink-receptive layer (A-8) mentioned below.

| <Coating solution for Ink-receptive layer (A-8)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 22 parts |
| Cationic water-soluble polymer (available from Nitto Boseki Co., Ltd., polyallylamine PAA-HCl-3L) | 1 part |
| Zirconyl acetate (available from DAIICHI KIGENSO KAGAKU KOGYO CO., LTD., Zircosol ZA-20, trade name) | 4 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

COMPARATIVE EXAMPLE 6

An ink-jet recording material of Comparative example 6 was obtained in the same manner as in Example 5 except for changing the coating solution for the ink-receptive layer (B-6) of Example 5 to a coating solution for an ink-receptive layer (B-10) mentioned below.

| <Coating solution for Ink-receptive layer (B-10)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Zirconyl acetate (available from DAIICHI KIGENSO KAGAKU KOGYO CO., LTD., Zircosol ZA-20, trade name) | 8 parts |
| Surfactant (Betaine series; available from Nippon Surfactant Kogyo K.K., Japan, SWANOL AM-2150, trade name) | 0.3 part |

COMPARATIVE EXAMPLE 7

An ink-jet recording material of Comparative example 7 was obtained in the same manner as in Example 5 except for changing the coating solution for the ink-receptive layer (B-6) of Example 5 to a coating solution for an ink-receptive layer (B-11) mentioned below.

| <Coating solution for Ink-receptive layer (B-11)> | |
|---|---|
| Fumed silica dispersion 1 (as a solid content of the fumed silica) | 100 parts |
| Boric acid | 3 parts |
| Polyvinyl alcohol (Saponification degree: 88%, Average polymerization degree: 3500) | 20 parts |
| Cationic emulsion (Styrene-acryl series; available from Seiko PMC Corporation, SE2220, trade name) | 8 parts |
| Surfactant (Betaine series; available from Nippon Surfactant Kogyo K.K., Japan, SWANOL AM-2150, trade name) | 0.3 part |

COMPARATIVE EXAMPLE 8

An ink-jet recording material of Comparative example 8 was obtained in the same manner as in Example 8 except for changing the coating solution for the ink-receptive layer (A-7) of Example 8 to a coating solution for an ink-receptive layer (A-9) mentioned below.

| <Coating solution for Ink-receptive layer (A-9)> | |
|---|---|
| Wet process silica dispersion 1 (as a solid content of the wet process silica) | 50 parts |
| Fumed silica dispersion 1 (as a solid content of the fumed silica) | 50 parts |
| Boric acid | 3 parts |
| Polyvinyl alcohol (Saponification degree: 88%, Average polymerization degree: 3500) | 22 parts |
| Cationic water-soluble polymer (available from Nitto Boseki Co., Ltd., polyallylamine PAA-HCl-3L, trade name) | 1 part |
| a cationic emulsion (Styrene-acryl series; available from Seiko PMC Corporation, SE2220, trade name) | 4 parts |
| Zirconyl acetate (available from DAIICHI KIGENSO KAGAKU KOGYO CO., LTD., Zircosol ZA-20, trade name) | 4 parts |
| 1,1,5,5-Tetramethylcarbohydrazide | 2 parts |
| Surfactant (Betaine series; available from Nippon Surfactant Kogyo K.K., Japan, SWANOL AM-2150, trade name) | 0.1 part |

In addition to evaluations of the ink-absorption property, coloring property and high-humidity bleeding mentioned in Example 1, evaluation of coating property mentioned below was carried out. The results are shown in Table 2.

<Coating Property>

A state of the coated surface was observed with naked eyes and evaluated.

TABLE 2

| Sample | Ink-absorption property | Coloring property | High humidity bleeding | Coating property |
|---|---|---|---|---|
| Example 5 | ◎ | ◎ | ◎ | ○ |
| Example 6 | ◎ | ◎ | ○ | ○ |
| Example 7 | ◎ | ◎ | ◎ | ○ |
| Example 8 | ○ | ○ | ◎ | ○ |
| Example 9 | ○ | ○ | ◎ | ○ |
| Comparative example 5 | ○ | ◎ | ◎ | X |
| Comparative example 6 | Δ | ◎ | X | Δ |
| Comparative example 7 | Δ | X | Δ | ○ |
| Comparative example 8 | Δ | ○ | ◎ | X |

◎: No surface defect was admitted and good coating surface was formed.
Δ: Slight cracking was observed on the surface.
X: Remarkable cracking was observed on the surface.

The ink-jet recording materials of Examples 5 to 9 of the present invention showed excellent results in ink-absorption property, coloring property and high-humidity bleeding of the ink-receptive layer. With regard to Comparative examples 5 and 8, these are samples in which the water-soluble zirconium compound is not present in the ink-receptive layer (A) apart from the support with a larger amount, so that they gave a result that fine cracks occurred, many surface defects were present and coating property was poor. Comparative example 6 is a case in which no cationic emulsion is contained in the ink-receptive layer (B), so that it gave a result that fixation of ink dye was insufficient and high-humidity bleeding was poor. Moreover, ink-absorption property or coating property was affected to cause poor results. Comparative example 7 is a case in which no water-soluble zirconium compound is contained in the ink-receptive layer (B), so that an effect of the cationic emulsion on coloring property was remarkable whereby poor results were obtained. Moreover, ink-absorption property was affected to cause poor results.

The invention claimed is:

1. An ink-jet recording material having at least two ink-receptive layers (A) and (B) mainly containing fine particulate silica on a water-resistant support, which comprises said ink-receptive layer (A) positioned nearer to the support versus said ink-receptive layer (B), wherein the fine particulate silica is fumed silica, having an average secondary particle size of 500 nm or less, the ink-receptive layer (B) contains a water-soluble zirconium compound, and the ink-jet recording material satisfies the following requirement(s) (b), or (a) and (b):

(a) the water-soluble zirconium compound is present with a larger amount in the ink-receptive layer (B) and a cationic emulsion is contained in the ink-receptive layer (B), (b) a water-soluble aluminum compound is contained in the ink-receptive layer (A), and a distribution of the water-soluble aluminum compound is not uniform in the whole ink-receptive layers and the water-soluble aluminum compound is present in a larger amount in the ink-receptive layer (A).

2. The ink-jet recording material according to claim 1, wherein the ink-receptive layer contains a hydrophilic binder, and a weight ratio (B/P) of the hydrophilic binder and the fine particulate silica in the ink-receptive layer (B) is smalier than the weight ratio (B/P) of the same in the ink-receptive layer (A).

3. The ink-jet recording material according to claim 1, wherein a weight ratio of fine particulate silica contained in the ink-receptive layer (A) and that in the ink-receptive layer (B) is 10:1 to 10:8, the ink-receptive layer (B) contains the cationic emulsion, and a ratio of the water-soluble zirconium compound bases on the fine particulate silica in the ink-receptive layer (A) is 1% by weight or less and a ratio of the same in the ink-receptive layer (B) is 3% by weight or more.

4. The ink-jet recording material according to claim 1, wherein the ink-receptive layer (B) is an uppermost layer.

5. The ink-jet recording material according to claim 1, wherein a dry coated amount of the ink-receptive layer (A) is 12 g/$m^2$ or more, and a dry coated amount of the ink-receptive layer (B) containing the water-soluble zirconium compound is 8 g/$m^2$ or less.

* * * * *